US011801612B2

(12) United States Patent
Jorkama

(10) Patent No.: US 11,801,612 B2
(45) Date of Patent: Oct. 31, 2023

(54) DEVICE FOR DETERMINING AND STORING ECCENTRICITY OF CUSTOMER ROLL WITHIN A SLITTER WINDER AND USING FOR UNWINDING CONTROL

(71) Applicant: Valmet Technologies Oy, Espoo (FI)

(72) Inventor: Marko Jorkama, Porvoo (FI)

(73) Assignee: Valmet Technologies Oy, Espoo (FI)

( * ) Notice: Subject to any disclaimer, the term of this patent is extended or adjusted under 35 U.S.C. 154(b) by 133 days.

(21) Appl. No.: 17/505,292

(22) Filed: Oct. 19, 2021

(65) Prior Publication Data

US 2022/0118638 A1 Apr. 21, 2022

(30) Foreign Application Priority Data

Oct. 20, 2020 (FI) ..... 20206034

(51) Int. Cl.

| | |
|---|---|
| ***B26D 7/27*** | (2006.01) |
| ***B26D 1/24*** | (2006.01) |
| ***B65H 18/14*** | (2006.01) |
| ***B65H 23/195*** | (2006.01) |

(52) U.S. Cl.

CPC ..... *B26D 1/245* (2013.01); *B26D 7/27* (2013.01); *B65H 18/145* (2013.01); *B65H 23/1955* (2013.01); *B65H 2301/4148* (2013.01); *B65H 2513/10* (2013.01); *B65H 2513/11* (2013.01)

(58) Field of Classification Search

CPC ..... B26D 1/245; B26D 7/27; B65H 18/145; B65H 23/1955; B65H 2513/11; B65H 2301/4148; B65H 2511/166

See application file for complete search history.

(56) References Cited

U.S. PATENT DOCUMENTS

2021/0394386 A1* 12/2021 Acciari ..... B26D 7/2635
2021/0394387 A1* 12/2021 Acciari ..... B65H 18/16

FOREIGN PATENT DOCUMENTS

| | | | |
|---|---|---|---|
| EP | 2080722 | A2 | 7/2009 |
| WO | 2010028867 | A1 | 3/2010 |
| WO | 2020078957 | A1 | 4/2020 |

* cited by examiner

*Primary Examiner* — Sang K Kim

(74) *Attorney, Agent, or Firm* — Stiennon & Stiennon

(57) ABSTRACT

A measuring device is releasably received within a winding core of a customer roll wound on a slitter-winder (10). The measuring device (20) is releasably fastened within the winding core by fastening element(s) (21) securing the device to the winding core (10) for rotation during winding of the fiber web around the winding core to form the customer roll. Eccentricity of the customer roll as it is wound is determined from movement, speed and/or acceleration data received from at least two sensors of the measuring device and data is stored for use in unwinding the fiber web from the customer roll and serving as control information. Tension variations in unwinding can thus be anticipated and premeditative steps taken to ensure smooth running of the fiber web in unwinding in further processing.

17 Claims, 2 Drawing Sheets

DEVICE FOR DETERMINING AND STORING ECCENTRICITY OF CUSTOMER ROLL WITHIN A SLITTER WINDER AND USING FOR UNWINDING CONTROL

CROSS REFERENCES TO RELATED APPLICATIONS

This application claims priority on Finnish Application No. 20206034, filed Oct. 20, 2020, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates generally to slitter-winders for winding longitudinally slit paper and board webs into customer rolls, and more particularly to slitter-winders with measuring devices connected to the customer rolls.

It is known that a fiber web, e.g., paper, is manufactured in machines which together constitute a paper-manufacturing line which can be hundreds of meters long. Modern paper machines can produce over 450,000 tons of paper per year. The speed of the paper machine can exceed 2,000 m/min and the width of the paper web can be more than 11 meters.

In paper-manufacturing lines, the manufacture of paper takes place as a continuous process. A paper web completing in the paper machine is reeled by a reel-up around a reeling shaft i.e., a reel spool into a parent roll the diameter of which can be more than 5 meters and the weight more than 160 tons. The purpose of reeling is to modify the paper web manufactured as planar to a more easily processable form. On the reel-up located in the main machine line, the continuous process of the paper machine breaks for the first time and shifts into periodic operation.

The web of parent roll produced in paper manufacture is full-width and even more than 100 km long so it must be slit into component webs with suitable width and length for the customers of the paper mill and wound around winding cores into so-called customer rolls before delivering them from the paper mill. This slitting and winding up of the web takes place as known in an appropriate separate machine i.e. a slitter-winder.

On the slitter-winder, the parent roll is unwound in an unwinding section, the wide web is slit on a slitting section into several narrower component webs which are wound up on a winding section around winding cores, such as spools, into customer rolls. When the customer rolls are completed, the slitter-winder is stopped and the wound rolls i.e., the so-called set is removed from the machine and new winding cores for new component web rolls are to be transferred to winding stations for winding a new set of component web rolls. Then, the process is continued with the winding of a new set. These steps are repeated periodically until paper runs out of the parent roll, whereby a parent roll change is performed and the operation starts again as the unwinding of a new parent roll.

Slitter-winders employ winding devices for winding the customer rolls of different types depending on, inter alia, the type of the fiber web being wound. On slitter-winders of the two drum winder type, the web is guided from the unwinding via guide rolls to the slitting section, where the web is slit into component webs, which are further guided to the winding (support or carrier) drum of the two drum winder and slit component webs are wound around a winding core on support of the winding drums. On slitter-winders of the multi-station winder type, the web is guided from the unwinding via guide rolls to the slitting section, where the web is slit into component webs, which are further guided to the winding drum/drums on the winding stations to be wound up onto winding cores into customer rolls. Adjacent component webs are wound up on different sides of the winding drum/drums. Multi-station winders have one to three winding drums and in them each component web is wound to a component web roll in its own winding station. On the winding section of the slitter-winders the winding cores for the customer rolls to be wound around these winding cores are supported by core locks placed at both ends of the winding cores or at both ends of a winding core array comprising several winding cores successively.

It is know from the prior art that in winding, in which narrower component fiber webs slit in the slitting section of the slitter-winder from the fiber web unwound from the parent reel are wound into the customer rolls, because of variations in the cross-direction profiles, for example, thickness, moisture and roughness, of the fiber web to be wound, an eccentric customer roll is formed and additionally adjacent customer rolls are not formed with precisely equally large diameters, in spite of the fact that, in principle, substantially equally long component fiber webs are wound into them. Owing to the different diameters of the rolls and the eccentricity of one customer rolls, problems can occur in the winding as well as in further processing of the fiber web on the customer rolls. Eccentricity, possibly enhanced by profile defects of component fiber webs, may cause a bouncing phenomenon, in which customer rolls vibrate on winding drums and further increase the eccentricity. This may even cause bouncing-off of the customer rolls from the winder. The bouncing phenomenon decreases winding capacity, because running speed must be lowered during winding to avoid the vibration causing bouncing/eccentricity of customer rolls. Furthermore, tension variation of the fiber web wound on the customer roll is a substantial factor in a printing process as well as in finishing and further processing of the fiber web on the customer roll. The tension variation of the fiber web unwound from the customer roll has a negative correlation when unwinding an eccentric customer roll. Thus, there exists a clear need to have knowledge of the eccentricity of the customer roll in further processing of the customer rolls. Additionally, the eccentricity information can be utilized in the slitter-winder to control running parameters, for example deceleration, acceleration and speed, in relation to the winding diameter of the customer rolls. Presently, the eccentricity of the customer rolls is measured manually by tape measuring the finished, wound customer rolls. This known method provides only inaccurate measuring results, takes a lot of time and gives no information of reasons of formation of the eccentricity of the customer roll.

Many of the above problems and disadvantages occur in winding irrelevant of the type of the slitter-winder used.

One object of the invention is to eliminate or at least minimize the above problems and disadvantages of prior art slitter-winders, in particular relating to defining eccentricity of customer rolls.

SUMMARY OF THE INVENTION

The slitter-winder according to the invention has an unwinding section for unwinding a fiber web from a parent roll, a slitting section for slitting the fiber web to component fiber webs and a winding section. The winding section has a winder, for winding the component fiber webs around winding cores to customer rolls. Inside at least one of the winding cores is located at least one measuring device which is releasably fastened by fastening element(s) such that the measuring device is configured to rotate with the winding core during winding of the customer roll around the winding core.

According to an advantageous feature of the invention the measuring device has at least two sensors which are configured to measure movement, speed and/or acceleration. Based on the measurement results received from the sensors eccentricity of the customer roll is calculated and eccentricity information is provided. Advantageously, the sensors are 2D-sensors and measure in relation to the rotation axis of the winding core in two perpendicular (xy) directions. Advantageously, two sensors are used and the two sensors are positioned in perpendicular positions in respect of each other. Alternatively, advantageously the sensors are 3D-sensors that measure to three perpendicular (xyz) directions.

According to an advantageous feature of the invention the slitter-winder has a remote data unit comprising a data reading and/or a data storing and/or data calculating and/or control means.

According to an advantageous feature of the invention the measuring device is configured to provide measurement results of the sensors wirelessly by wireless data transmitting means to the remote data unit comprising the data reading and/or the data storing and/or the data calculating and/or the control means.

According to an advantageous feature of the invention the measuring device comprises a data transfer cable and a data storage and the measuring device is configured to store the measurement results of the sensors in the data storage and configured to provide measurement results of the sensors via the data transfer cable to the data reading and/or the data storing and/or the data calculating and/or the control means.

According to an advantageous feature of the invention the winding core has two measuring devices during the winding of the customer roll.

According to an advantageous feature of the invention in cross-direction of the winding section at least the outermost winding cores during winding have at least one measuring device.

According to an advantageous feature of the invention the sensors are acceleration sensors configured to measure acceleration in perpendicular level opposite to the cross-direction of the slitter-winder in two directions.

According to an advantageous feature of the invention the sensors have the capability of measuring acceleration when the frequency is 0 Hz.

According to an advantageous feature of the invention the measuring device is configured to be fastened releasably against the inner surface of the winding core before the winding core is placed in the winder and configured to be removed from the winding core when the finished customer roll has been removed from the winder.

According to an advantageous aspect of the invention at least one measuring device is located inside at least one winding core, around which a customer roll is to be formed by winding around it a component fiber web unwound from a parent roll in an unwinding of the slitter-winder and slit to component fiber webs in a slitting section of the slitter-winder. The measuring device is fastened by fastening elements inside the winding core such that it rotates with the customer roll. The measuring device comprises at least two sensors for measuring rotational movement and/or rotational speed and/or acceleration. Advantageously, the measuring device comprises at least two acceleration sensors which measure acceleration in perpendicular level opposite to the cross-direction of the slitter-winder in two directions. Advantageously, the sensors have the capability of measuring acceleration also when the frequency is 0 Hz.

The invention is especially suitable when eccentricity information is desired, but the invention can also be utilized when it is desired to measure information with regard to vibration, vibration modes and/or bouncing. Based on the measurement results reasons of difficulties in reaching desired running speeds can be found out and thereafter the difficulties can be solved and thus increased running speeds and increased capacity provided. The eccentricity information can be used in quality control and in control of further treatment of the customer roll and in control of the winding of customer rolls.

The eccentricity result is provided in acceleration term e*w^2 of the measurement result, in which eccentricity term e stands for deviation of the center of the winding core from the rotation axis and w stands for angular speed of the customer roll. This term is constant in a rotating reference frame attached to the core. Thus, the acceleration term e*w^2 can easily be calculated from the measurement result. The measurement results provide information relating to development of eccentricity during winding and to eccentricity of the finished customer roll. Based on the eccentricity information in further processing of the customer rolls, tension variations in unwinding can be anticipated and thus premeditative steps can be taken to ensure smooth running of the fiber web in unwinding in the further processing.

The invention is utilizable in winding of component fiber web rolls in winders of slitter-winders, especially in two-drum winders and in multi-station winders. In this description and the claims by fiber web is meant paper web, board web and pulp web.

BRIEF DESCRIPTION OF THE DRAWINGS

Aspects of the invention, however, together with additional objects and advantages thereof, will be best understood from the following description of some example embodiments when read in connection with the accompanying drawings and in the following the invention is described in more detail referring to the accompanying drawing.

DESCRIPTION OF THE PREFERRED EMBODIMENTS

During the course of this description like numbers and signs will be used to identify like elements according to the different views which illustrate the invention. Repetition of some reference signs may have been omitted in the figures for clarity.

Figure 1:
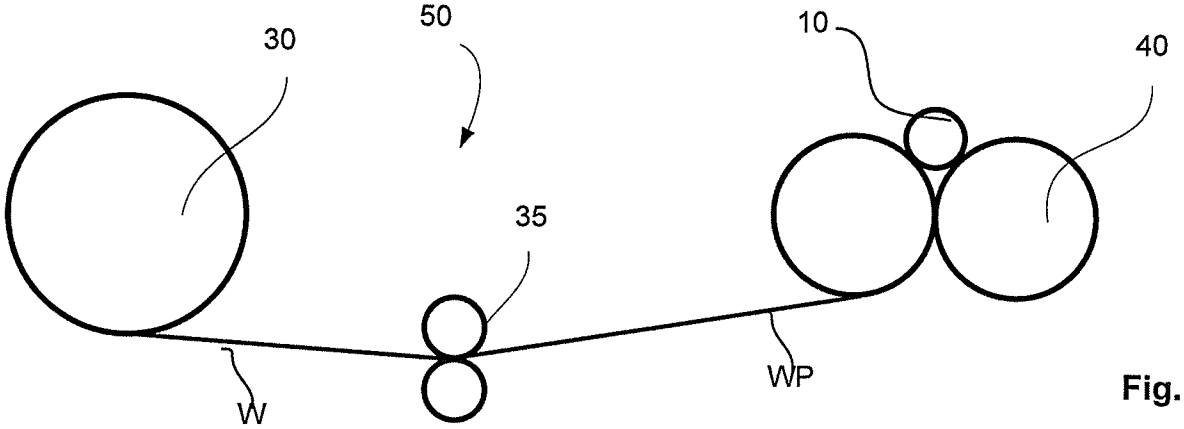
In FIG. 1 is schematically shown an example of a slitter-winder.

In FIG. 1 is shown an example of a slitter-winder 50 for producing customer rolls of fiber web. The slitter-winder 50 comprises an unwinding section 30, a slitting section 35 and a winding section 40. In the winding section 30 a parent roll of fiber web W is unwound and thereafter, the fiber web w is slit in longitudinal direction to component fiber webs WP in the slitting section 35. The component fiber webs WP are wound in the winding section 40 around winding cores 10 to customer rolls.

Figure 2B:
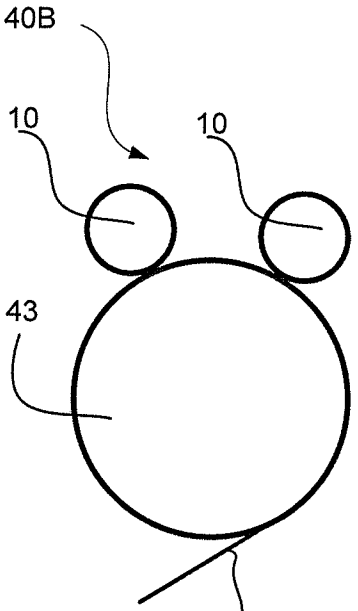
In FIGS. 2A-2B is schematically shown examples of winding sections of slitter-winders.
Figure 2A:
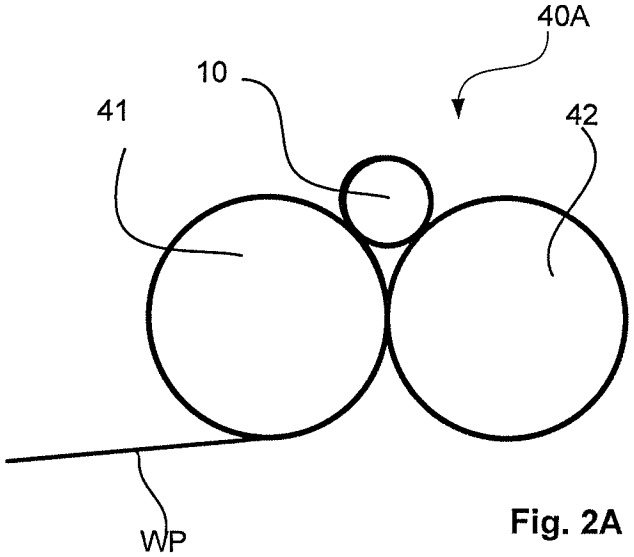

In FIGS. 2A-2B is shown examples of winding sections 40 of slitter-winders. In FIG. 2A is shown an example of a winding section of a two drum winder 40A, to which the component fiber webs WP are guided from the slitting section 35 (such as shown in FIG. 1), where the fiber web W is slit into component webs WP. The component fiber webs WP are guided to the winding (support or carrier) drum 41 of the two drum winder 40A and are wound around winding cores 10 on support of the winding drums 41, 42. In FIG. 2A is shown an example of a winding section 40 of a multi-station winder 40B, to which the component fiber webs WP are guided from the slitting section 35 (FIG. 1), where the fiber web W is slit into component fiber webs WP. The component fiber webs WP are guided to the winding drum/drums 43 on the winding stations to be wound up onto winding cores. Adjacent component webs are wound up on different sides of the winding drum/drums 43 round winding cores 10 into customer rolls. Multi-station winders 40B have one to three winding drums 43 and in them each component fiber web WP is wound around the winding core 10 to a customer roll in its own winding station.

Figure 3:
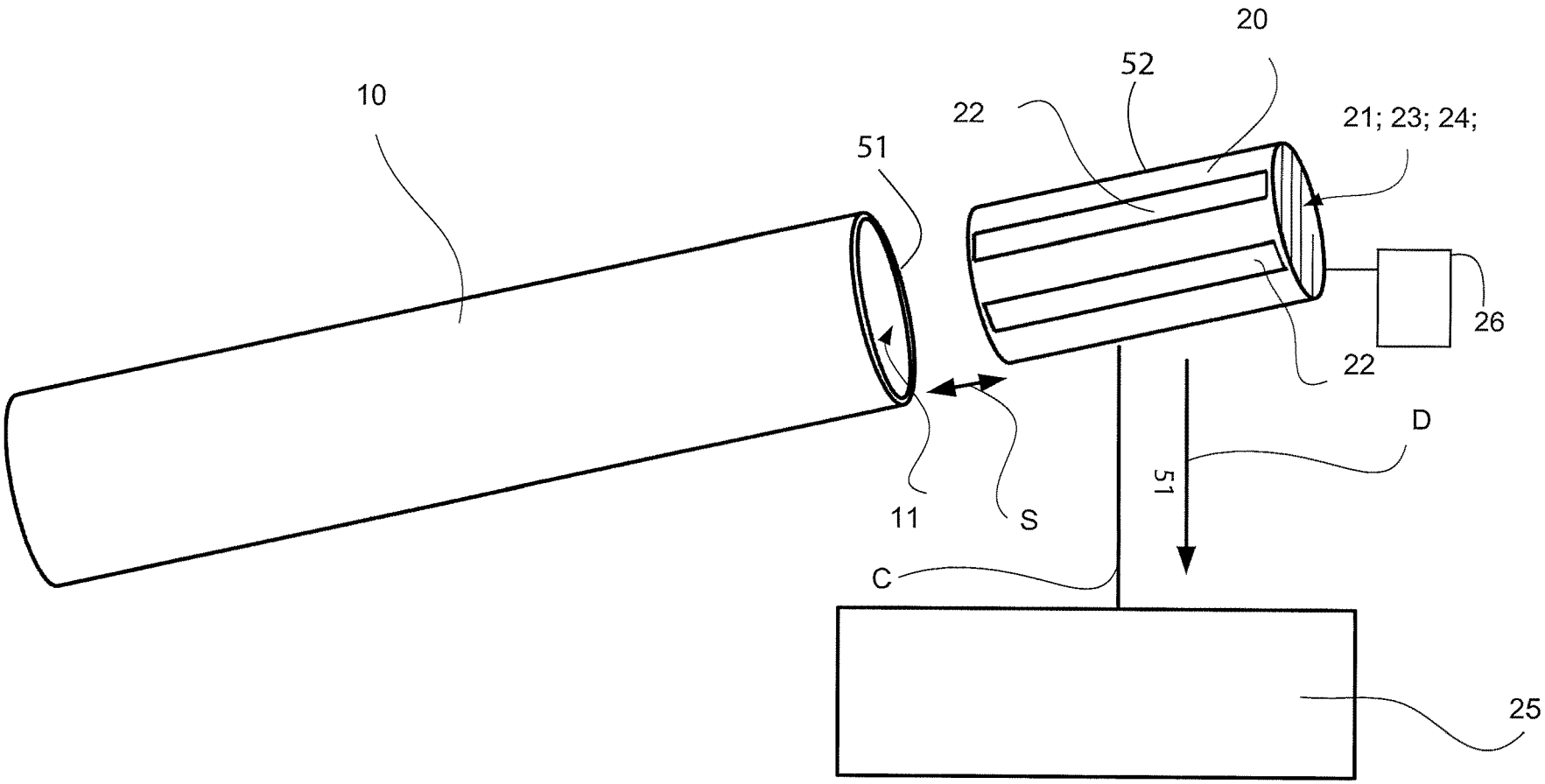
In FIG. 3 is schematically shown an advantageous example of a measurement system of a slitter-winder according to the invention.

In FIG. 3 is shown an example of a measurement system of a slitter-winder 50 (such as shown in FIG. 1). The measurement system comprises a measuring device 20 configured to be located inside a winding core 10. The winding core 10 is tube-like and has an inner cylindrical opening 51 which extends through the winding core 10. The opening 51 is limited by inner surfaces 11 of the winding core 10. The measuring device 20 has a frame 52 with fastening element (s) 21, by which the measuring device 20 is fastened releasably against the inner surface of the winding core 10 and thus, inside the winding core 10 such that the measuring device 20 rotates with the winding core 10 when the customer roll is wound around the winding core. The fastening element(s) 21 can be for example expansion fastening element(s) which include a member which extends radially outwardly to frictionally engage the inner surface of the winding core. The measuring device 20 also has at least two sensors 22 mounted to the frame 52 for measuring rotational movement and/or rotational speed and/or acceleration. Advantageously, the sensors 22 is/are acceleration sensors but also sensors based on movement or speed can be used.

The measuring device 20 is movable inside the winding core 10 and out from the winding core 10, as shown by the arrow S, i.e. the measuring device 20 is replaceable. Advantageously, the measuring device 20 is placed inside the winding core 10 and fastened before winding and, after winding is complete, the measuring device 20 is released and removed from the winding core 10. The measuring device 20 can also be left inside the winding core of the finished customer roll and then be used as a control information source in unwinding in further processing of the customer roll.

In the winder 40A, 40B of the winding section 40 of the slitter-winder 50 there is provided at least one measuring device 20 inside at least one winding core 10 during winding. Advantageously, one to two measuring devices 20 are provided inside the at least one winding core 10. Advantageously, in the winder 40A, 40B of the winding section 40 of the slitter-winder all the winding cores 10, around which customer rolls are to be wound, are provided with one to two measuring devices 20 during winding, preferably in the cross-direction of the winding section 40 at least the outermost winding cores of the winding core array are provided with one to two measuring devices 20 inside the winding cores 10 during winding. Preferably, each measuring device 20 located inside the winding core 10 is positioned as exactly as possible at the center axis of the winding core 10.

The measuring device 20 may also comprise data storage 23, for example a data logger, to store the measurement results received from the sensors 22. The measuring device 20 may also comprise signal transmitting means 24 to wirelessly transmit by wireless transmitter D the measurement results received form the sensors 22 to a remote data unit 25 having a wireless receiver and comprising a data reading and/or a data storing and/or data calculating and/or control element, advantageously during winding a customer roll around the winding core 10. The measuring device 20 may also have a signal transmitting means 24 to transmit the measurement results received form the sensors 22 to the remote data unit 25 comprising the data reading and/or data calculating and/or control element via a data transfer cable C or like after a customer roll is wound to a finished customer roll.

Advantageously, the sensors 22 are acceleration sensors, which measure acceleration in a perpendicular level opposite to the cross-direction of the slitter-winder 50 in two directions. Advantageously, the sensors 22 have the capability of measuring acceleration also, when frequency is 0 Hz. Advantageously, the sensors are 2D-acceleration sensors and measure acceleration in relation to the rotation axis of the winding core in two perpendicular (xy) directions. Advantageously, two sensors are used and the two sensors are positioned in perpendicular positions in respect of each other. Alternatively, advantageously the sensors are 3D-sensors that measure to three perpendicular (xyz) directions.

The eccentricity result is provided in the acceleration term e*w^2 of the measurement result, in which eccentricity n term e stands for deviation of the center of the winding core from the rotation axis and w stands for angular speed of the customer roll. This term is constant in a rotating reference frame attached to the core. Thus, the acceleration term e*w^2 can easily be calculated from the measurement result. The measurement results provide information relating to development of eccentricity during winding and to eccentricity of the finished customer roll. As the eccentricity terms, when measuring by rotating sensor, are constant, the eccentricity result is easily calculated based on the measurement results and the eccentricity information is provided. This calculation may be carried out electronically in a processing unit 26 within the measuring device and shown schematically in FIG. 3, or alternatively in the remote data unit or elsewhere. The eccentricity information provides information in regard of conditions causing eccentricity, for example diameter of customer roll during winding susceptible to eccentricity and running speed sensitive to causing eccentricity.

The term e*w^2 is calculated in the following way from the measurement data of the rotating sensors, for example rotating acceleration sensors i.e. rotating accelerometer: DC (Direct Current) component of the signal (i.e. 0 Hz frequency component) is calculated by filtering or by averaging or by some other signal processing tool. The DC component is equal to e*w^2.

In the description in the foregoing, although some functions have been described with reference to certain features, those functions may be performable by other features whether described or not. Although features have been described with reference to certain embodiments or examples, those features may also be present in other embodiments or examples whether described or not. Above the invention has been described by referring to some advantageous examples only to which the invention is not to be narrowly limited. Many modifications and alterations are possible within the invention as defined in the following claims.

I claim:

1. A slitter-winder comprising:

an unwinding section for unwinding a fiber web from a parent roll;

a slitting section for slitting the fiber web to component fiber webs;

a winding section, which comprises a winder for winding the component fiber webs around winding cores to customer rolls; and inside at least one of the winding cores at least one measuring device releasably fastened by at least one fastening element within the at least one of the winding cores, and thereby fastened to rotate with the winding core during winding of the customer roll around the winding core, the measuring device comprising at least two sensors, which are configured to measure movement, speed and/or acceleration;

a data storage which records the measured movement, speed and/or acceleration as the customer roll is wound, wherein the at least two sensors are 2D-acceleration sensors configured to measure acceleration in a perpendicular level opposite to a cross-direction of the slitter-winder in two directions.

2. A slitter-winder comprising:

an unwinding section for unwinding a fiber web from a parent roll;

a slitting section for slitting the fiber web to component fiber webs;

a winding section, which comprises a winder for winding the component fiber webs around winding cores to customer rolls; and inside at least one of the winding cores at least one measuring device releasably fastened by at least one fastening element within the at least one of the winding cores, and thereby fastened to rotate with the winding core during winding of the customer roll around the winding core, the measuring device comprising at least two sensors, which are configured to measure movement, speed and/or acceleration;

a data storage which records the measured movement, speed and/or acceleration as the customer roll is wound, wherein the measuring device is configured to be fastened releasably against an inner surface of the winding core before the winding core is placed in the winder and configured to be removed from the winding core, when the finished customer roll has been removed from the winder.

3. The slitter-winder of claim 2 further comprising a processing element unit which based on the measured movement, speed and/or acceleration received from the at least two sensors calculates eccentricity of the customer roll over the course of the winding of the customer roll.

4. The slitter-winder of claim 2 further comprising a remote data unit spaced from the winding core, the remote date unit comprising a data reading and/or a data storing and/or a data calculating and/or control element.

5. The slitter-winder of claim 4 wherein the remote data unit further comprises a wireless receiver, and wherein the measuring device further comprises a wireless transmitter configured to provide measured movement, speed and/or acceleration to the remote data unit via the wireless receiver.

6. The slitter-winder of claim 2 further comprising a data transfer cable and wherein the measuring device is configured to store the measurement results of the sensors in the data storage and to provide measurement results of the sensors via the data transfer cable to a remote data unit.

7. The slitter-winder of claim 2 wherein two measuring devices are mounted to the winding core.

8. The slitter-winder of claim 2 wherein in the cross-direction of the winding section there are a plurality of customer rolls each having a winding core, and wherein at least outermost winding cores of the plurality of customer rolls during winding comprise at least one measuring device.

9. The slitter-winder of claim 2 wherein the at least two sensors have a capability of measuring acceleration, when frequency is 0 Hz.

10. An apparatus for determining, storing, and retrieving for future use the eccentricity over time of a customer roll as it is formed on a slitter-winder having an unwinding section for unwinding a fiber web from a parent roll, a slitting section for slitting the fiber web to component fiber webs, and a winding section having a winder for winding the component fiber webs around winding cores to customer rolls, the cores having axial openings, the apparatus comprising:

a frame which is receivable within a winding core axial opening;

at least one fastening element on the frame which is actuatable to releasably engage a winding core for rotating with the winding core during winding of the customer roll around the winding core;

at least two sensors on the frame which are configured to measure movement, speed and/or acceleration to determine data from which the eccentricity of the customer roll with time is calculated; and a data storage element which stores the data, such that the eccentricity of the customer roll at a position along a web wound on the customer roll can be recalled during the later processing of the customer roll.

11. The apparatus of claim 10 further comprising a customer roll of fiber web wound on a core while eccentricity data of the customer roll was stored in the data storage element, such that the data storage element is usable as a control information source in the unwinding of the customer roll in further processing.

12. The slitter-winder of claim 11 wherein the at least two sensors have a capability of measuring acceleration, when frequency is 0 Hz.

13. The apparatus of claim 10 wherein the data storage element is mounted to the frame.

14. The apparatus of claim 10 wherein the data storage element is remote from the frame, and further comprising a wireless transmitter mounted to the frame, and a wireless receiver mounted to the remote data storage element, such that data from the at least two sensors is transmittable over the wireless transmitter to the wireless receiver.

15. The apparatus of claim 10 wherein the data storage element is connected to the frame.

16. The apparatus of claim 10 further comprising a processing unit which based on the measured movement, speed and/or acceleration received from the at least two sensors calculates eccentricity of a customer roll within which the apparatus is mounted over the course of winding of the customer roll.

17. The slitter-winder of claim 10 wherein the at least two sensors are 2D-acceleration sensors configured to measure acceleration in a perpendicular level opposite to a cross-direction of the slitter-winder in two directions.

* * * * *